US005274399A

United States Patent [19]

Uchida et al.

[11] Patent Number: 5,274,399

[45] Date of Patent: Dec. 28, 1993

[54] RECORDING APPARATUS WITH SHIFTABLE CONVEYING UNIT

[75] Inventors: Takashi Uchida; Tomohiro Aoki, both of Yokohama; Yasushi Murayama; Tohru Kobayashi, both of Tokyo; Masatoshi Ikkatai, Kawasaki; Tatsuo Mitomi, Yokohama; Masaharu Nemura, Yokohama; Yasuyuki Takanaka, Yokohama, all of Japan

[73] Assignee: Canon Kabushiki Kaisha, Tokyo, Japan

[21] Appl. No.: 658,234

[22] Filed: Feb. 20, 1991

[30] Foreign Application Priority Data

Feb. 21, 1990 [JP] Japan ..... 2-38432

[51] Int. Cl.[5] ..... B41J 2/01; B41J 11/00; B65H 5/04

[52] U.S. Cl. ..... 346/134; 101/297; 346/140 R; 271/273; 400/649

[58] Field of Search ..... 346/140 R, 134, 145; 271/267, 273; 400/649, 647, 647.1; 101/297, 298

[56] References Cited

U.S. PATENT DOCUMENTS

| | | | |
|---|---|---|---|
| 4,520,726 | 6/1985 | Rouly et al. | 271/267 X |
| 4,558,333 | 12/1985 | Sugitani et al. | 346/140 R |
| 4,575,729 | 3/1986 | Ayers et al. | 346/75 |
| 4,614,949 | 9/1986 | Hakkaku et al. | 346/76 PH |
| 4,887,101 | 12/1989 | Hirose et al. | 346/134 |
| 4,893,137 | 1/1990 | Ebinuma et al. | 346/134 |
| 5,055,861 | 10/1991 | Murayama et al. | 346/140 R |

FOREIGN PATENT DOCUMENTS 59-123670 7/1984 Japan .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

Disclosed is a recording apparatus that includes a conveying device for conveying a recording sheet in a conveying direction, a recording device confronting the conveying device for recording an image on the sheet being conveyed and a supporting device for shiftably supporting at least one of the conveying device and the recording device for movement between a recording position where the conveying device and the recording device are in parallel contact with the recording sheet therebetween and a non-recording or separated position where the conveying device is separated from the recording device. In one embodiment, the recording device and the conveying device are separated in parallel in the non-recording position and the supporting device causes the at least one of the conveying device and the recording device to be non-parallel during movement from the non-recording position to the recording position. In another embodiment, during movement of the conveying device from the separated position to the recording position, the supporting device first causes a first end of the conveying device to obliquely shift towards the recording device and thereafter, causes a second end of the conveying device to shift toward the recording device.

20 Claims, 8 Drawing Sheets

RECORDING APPARATUS WITH SHIFTABLE CONVEYING UNIT

BACKGROUND OF THE INVENTION

1. Field of the Invention

The present invention relates to a recording apparatus used as an output device for a facsimile, copying machine, printer, a composite machine combining such machines, or a work station.

2. Related Background Art

Recently, output apparatus equipment such as facsimiles, copying machines, printers and the like have widely been popularized. In such recording apparatuses, particularly, in a recording apparatus using a cut sheet, there is provided a sheet conveying means wherein a cut sheet is supplied from a sheet supply portion to an image recording portion and then is conveyed from the recording portion to a sheet ejecting portion.

For example, U.S. Pat. No. 4,887,101 discloses recording apparatus wherein a cut sheet is conveyed by moving an endless belt attracting or absorbing the sheet thereon and an image is recorded on the sheet by a transfer drum disposed in confronting relation to the endless belt. When the sheet is jammed in a sheet feeding path resulting in stopping of the apparatus with the sheet remaining on the endless belt (this condition is called as "jam condition" hereinafter), a conveying unit including the endless belt is lowered to provide a space for facilitating an operation for removing the jammed sheet (this operation is called as "jam treatment" hereinafter) between the endless belt and the transfer drum.

In such a recording apparatus, when the conveying unit is moved from the lowered position to a recordable position, the conveying unit pushes up air remaining between the conveying unit and the transfer drum, thus creating an air flow. Since the conveying unit is lifted in parallel with the transfer drum, this air flow strikes against the transfer drum directly. Consequently, the dirt, dust, paper powder and the like entrained in the air flow will adhere to the transfer, drum, thus damaging the surface of the drum and/or adversely affecting the image formed on the drum.

SUMMARY OF THE INVENTION

An object of the present invention is to provide a recording apparatus which can provide a wide space for the jam treatment between a conveying unit and a recording means by shifting the conveying unit.

Another object of the present invention is to provide a recording apparatus which prevents an air flow created by the returning movement of the conveying unit from adversely affecting the recording means.

DETAILED DESCRIPTION OF THE PREFERRED EMBODIMENTS

First of all, a whole construction of a recording apparatus will be explained with reference to FIG. 2.

A scanner portion 1 is installed on a frame A of a recording apparatus. The recording apparatus includes an ink jet image recording means 2 activated in response to a signal from the scanner portion 1 to record image information, a belt conveying portion (conveying means) 4 for conveying a cut sheet (recording medium) 3 to the image recording means 2, and an absorbing roller 5.

The scanner portion 1 serves to scan an original B and comprises a light source 1*a* for illuminating light onto the original B resting on a platen C, a photoelectric converter element 1*b* such as a CCD for receiving the light reflected from the original B, and a short-focus image focusing lens 1*c* for focusing the light image on the photoelectric converter element 1*b*.

Figure 1B:
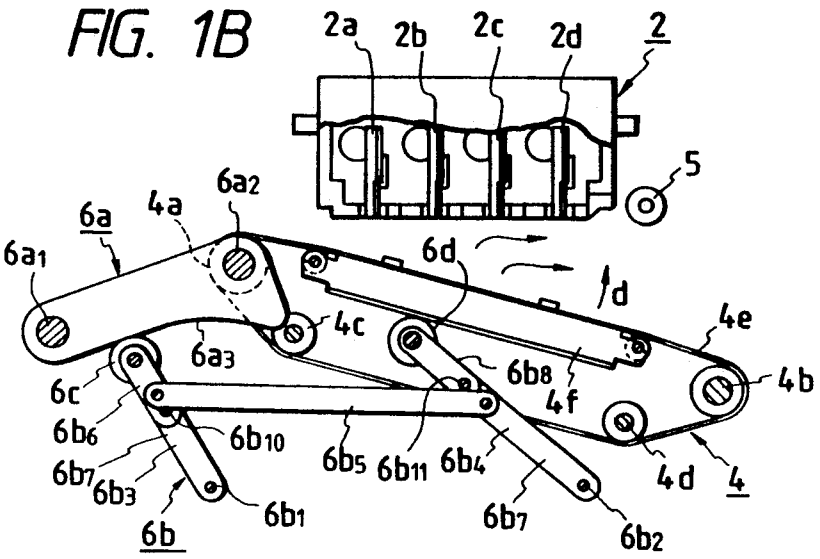
FIGS. 1A to 1D are explanatory views for explaining an operation of a support releasing mechanism.
Figure 1A:
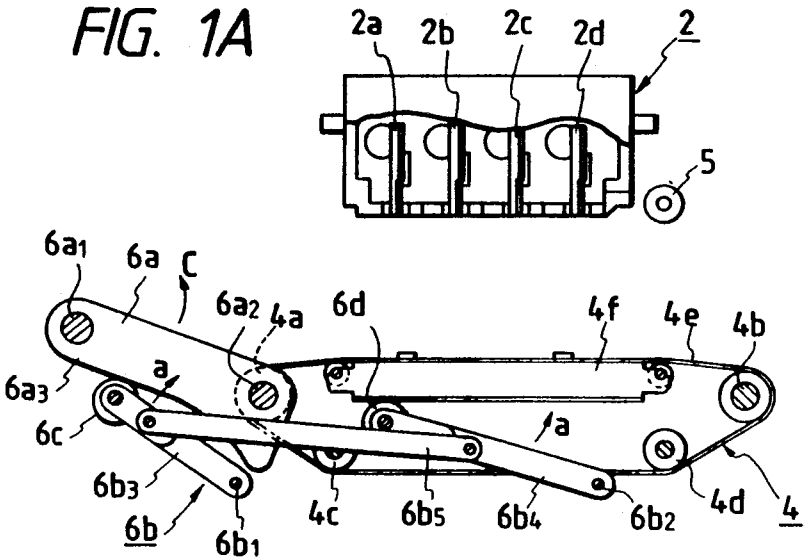
Figure 1C:
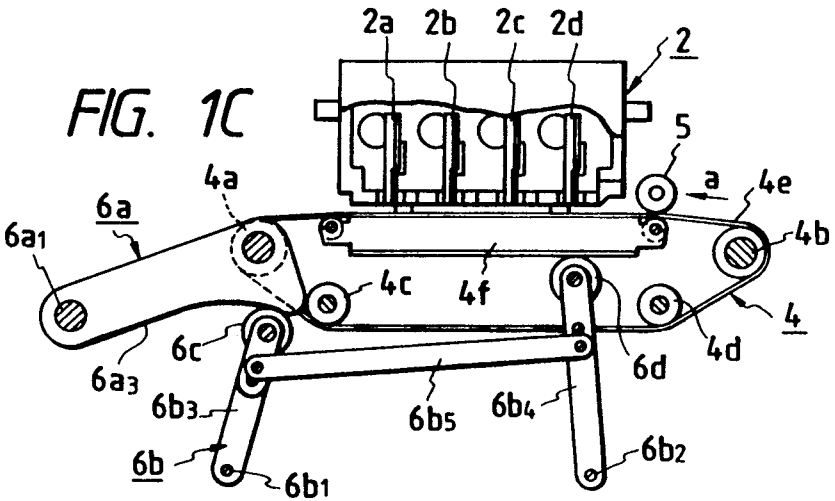
Figure 1D:
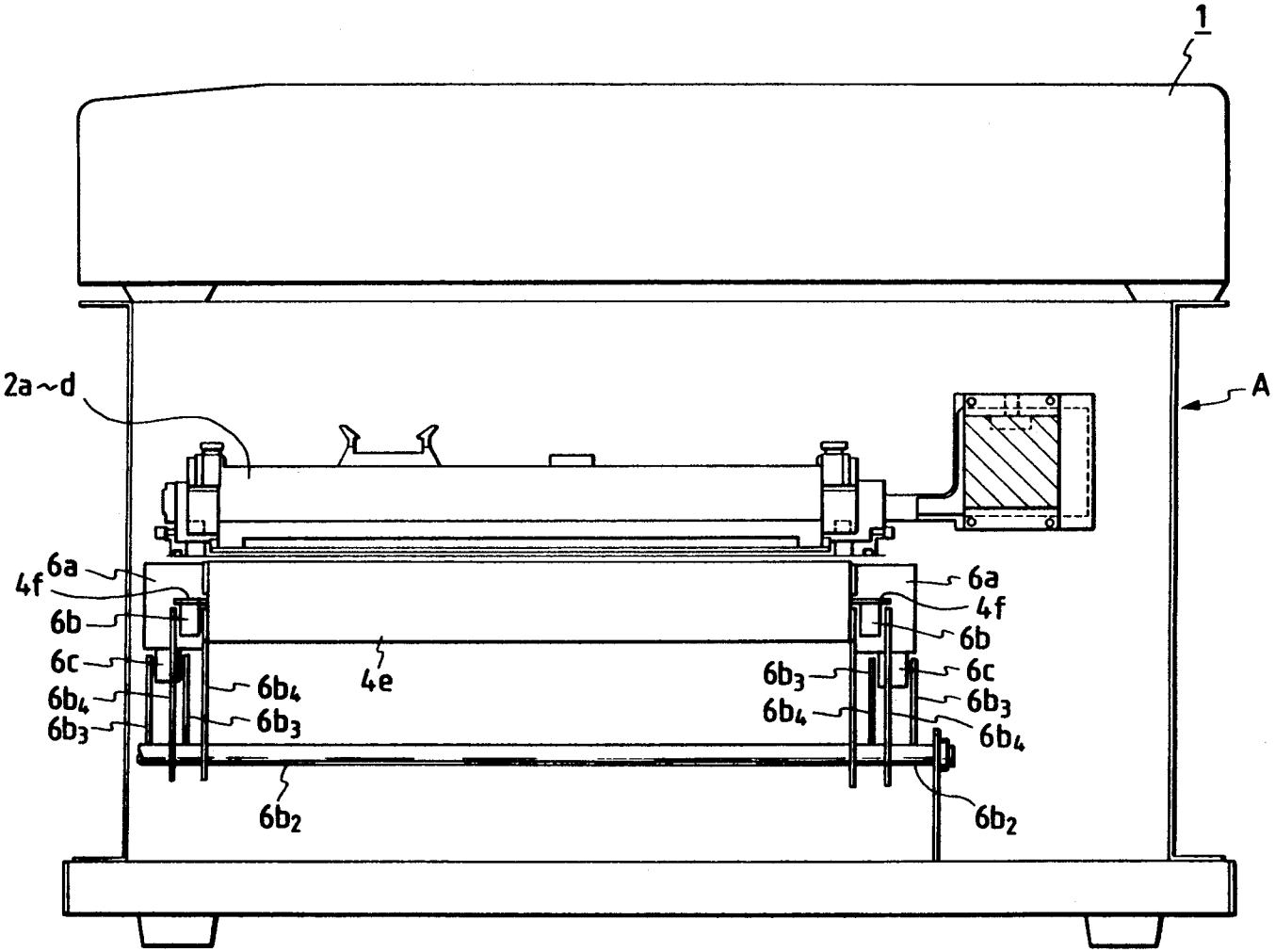

The belt conveying portion 4 is mounted within the frame A of the recording apparatus in such a manner that it can be shifted toward and away from the image recording means 2 by means of a support releasing mechanism (support releasing means) 6 shown in FIGS. 1A to 1C. During the recording operation, the belt conveying portion 4 is held to be spaced apart from the image recording means 2 by a distance of 1 mm or less.

At a lower portion of the recording apparatus, a cassette 7 containing the cut sheets 3 in a stacked condition is removably mounted within the apparatus frame A, and there is arranged a sheet supplying portion 8 comprising a separating roller 8*a* for separating the cut sheet 3 from the sheet stack in the cassette 7 one by one, conveying rollers 8*b* for conveying the cut sheet separated by the separating roller 8*a* toward the belt conveying portion 4 and the like.

Figure 2:
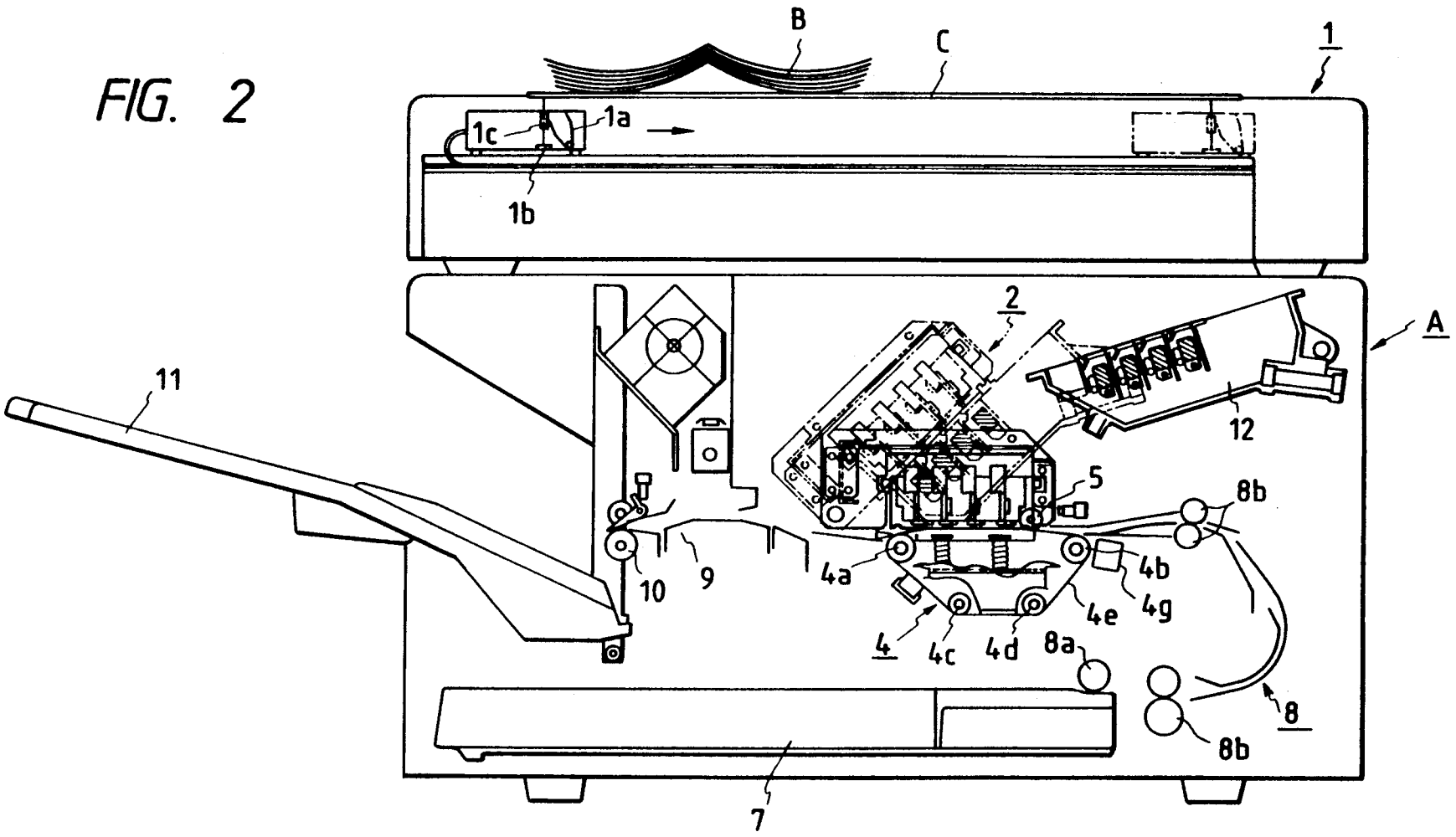
FIG. 2 is an elevational sectional view of a recording apparatus according to a preferred embodiment of the present invention, including the support releasing mechanism.

Upon a recording operation, the image recording means 2 is shifted from a waiting position shown by the phantom line in FIG. 2 to a recording position shown by the solid line.

Further, the scanner portion 1 scans the original B to read the image information on the original B, converts the image information into an electric signal, and sends it to the image recording means 2 as a drive signal. On the other hand, the cut sheet 3 separated by the separating roller 8*a* is supplied from the sheet supplying portion 8 to the belt conveying portion 4.

The cut sheet 3 passes between the absorbing roller 5 and the belt conveying portion 4, and then passes below the image recording means 2 while being absorbed by the belt conveying portion 4, where the image information is recorded on the cut sheet by discharging ink from the image recording means 2. Thereafter, the cut sheet 3 is ejected onto a ejector tray 11 disposed externally of the apparatus frame A by means of ejecting rollers 10 through a fixing and ejecting portion 9.

Incidentally, as shown in FIG. 2, a recovery cap portion 12 serves to act on the image recording means 2 when the latter is positioned in the waiting position, thereby preventing the non-discharge of ink from the image recording means, whereby the image recording means 2 is always maintained in a recordable condition.

Next, the concrete construction of the image recording means 2, belt conveying portion 4 and support releasing means 6 will be described.

Image Recording Means

The image recording means 2 preferably comprises a plurality of recording heads of ink jet recording type as shown in FIG. 2. Preferably, four recording heads 2*a*, 2*b*, 2*c* and 2*d* regarding black color ink, yellow color ink, magenta color ink and cyan color ink, respectively, are provided to permit color recording.

Each ink jet recording head includes ink discharge openings for discharging the recording ink liquid as ink droplets, liquid passages communicated with the corresponding discharge openings, and discharge energy generating means for applying discharge energy to the ink liquid in the respective liquid passages to form the droplets. By selectively energizing the discharge energy generating means in response to the image signal, the ink droplets are discharged to form the image on the cut sheet.

The discharge energy generating means may be, for example, a pressure energy generating means using electrical/mechanical converter elements such as piezo electric elements, an electromagnetic energy generating means for generating the droplets by applying an electromagnetic wave such as a laser to the ink liquid, or a thermal energy generating means using electrical/thermal converter elements. Among them, the thermal energy generating means using electrical/thermal converter elements is most preferable since the discharge openings can be arranged with high density and the recording head can be made compact.

In the illustrated embodiment, bubble jet recording heads of line-type which are one type of the ink jet recording heads are used as the image recording means.

Figure 3:
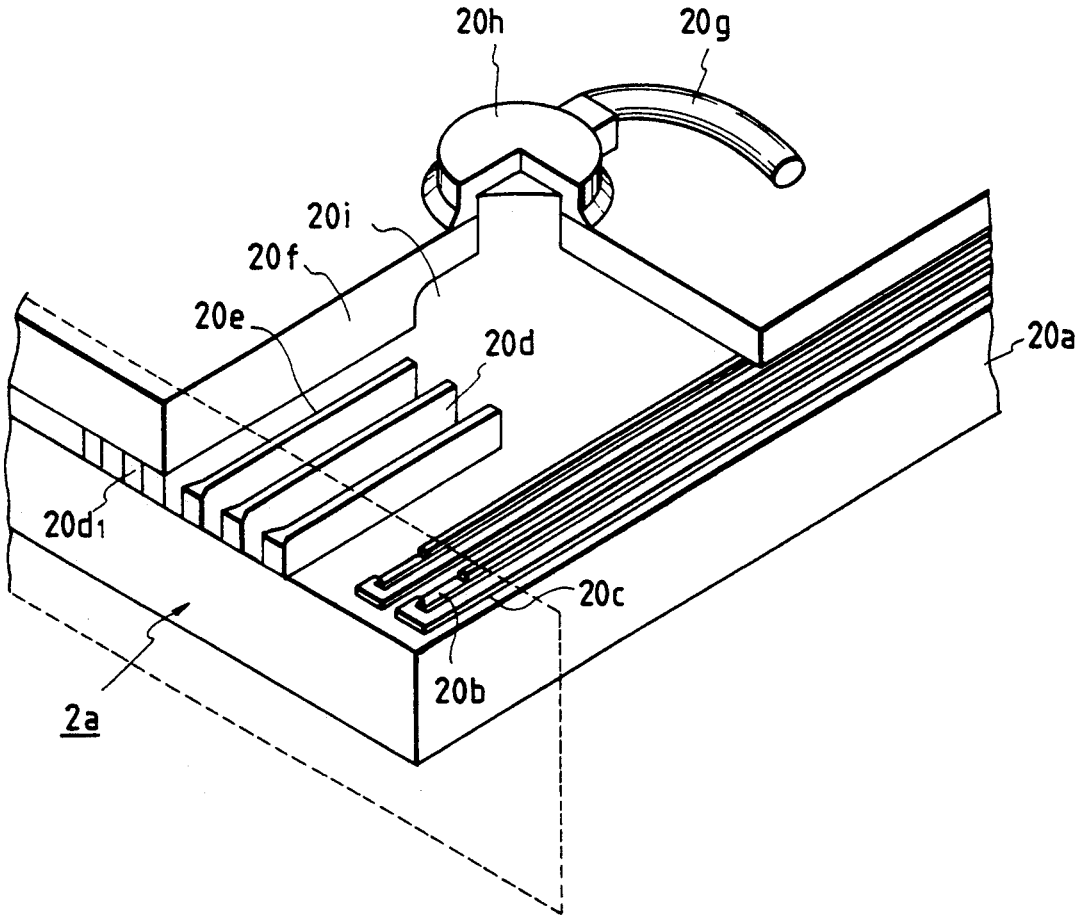
FIG. 3 is a fragmental perspective view of an ink jet recording head.

FIG. 3 shows a construction of the recording head 2*a* and FIGS. 4A to 4G show a principle of the bubble jet recording process. Incidentally, the recording heads 2*b*, 2*c* and 2*d* each have the same construction as that of the recording head 2*a*.

In FIG. 3, electrical/thermal converters (discharge heaters) 20*b* are formed on a silicon substrate 20*a* by a semi-conductor process such as etching, depositing, sputtering or the like, and electrodes 20*c* made of aluminum which supply electric power to the electrical/thermal converters are formed by a film forming process. The recording head 2*a* is completed by adhering a top plate 20*f* having partition walls 20*e* for defining recording liquid passages (nozzles) 20*d* to the substrate 20*a* so constructed. Further, an ink cartridge (not shown) for supplying the ink to the recording head 2*a* is removably mounted on the apparatus in place.

The ink supplied from the ink cartridge to the recording head 2*a* via a liquid supply tube 20*g* is directed to a common liquid chamber 20*i* in the head 2*a* through a connector 20*h* formed on the top plate 20*f* and then is sent to the nozzles 20*d* from the common liquid chamber 20*i*. The nozzles 20*d* are arranged along a whole width of the cut sheet 3 and have ink discharge openings $20d_1$, respectively, which are disposed at a predetermined pitch (for example, with a density of 16 nozzle/mm) along a sheet feeding direction in confronting relation to the cut sheet 3. In this way, the multi-nozzle bubble jet recording head 2*a* having the discharge openings $20d_1$ arranged across the whole recordable width of the sheet is obtained.

Now, a principle for forming a droplet in the bubble jet recording process will be explained with reference to FIGS. 4A to 4G.

Figure 4A:
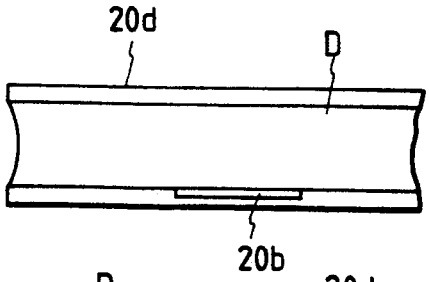
FIGS. 4A to 4G are explanatory views for explaining a principle of a bubble jet recording process.
Figure 4B:
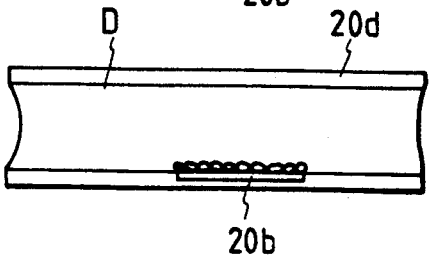
Figure 4C:
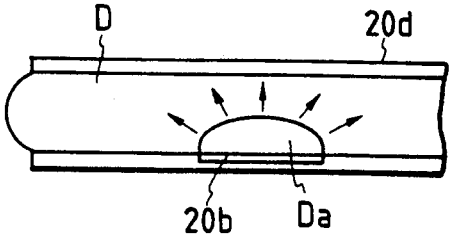

In the steady-state, as shown in FIG. 4A, a tension force of the ink D filled in the nozzle 20*d* is equalized with the external force at a discharge opening surface. In this condition, when the ink droplet is desired to be emitted, the electrical/thermal converter 20*b* disposed in the nozzle 20*d* is energized to abruptly increase the temperature of the ink in the nozzle 20*d* exceeding the nucleate boiling temperature. Consequently, as shown in FIG. 4B, the ink portion adjacent to the electric/-thermal converter 20*b* is heated to create a fine bubble Da, and then the heated ink portion D is vaporized to generate film boiling, thus growing the bubble quickly, as shown in FIG. 4C.

Figure 4D:
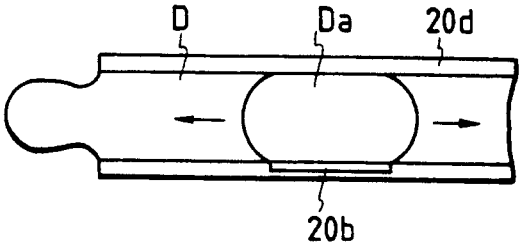
Figure 4E:
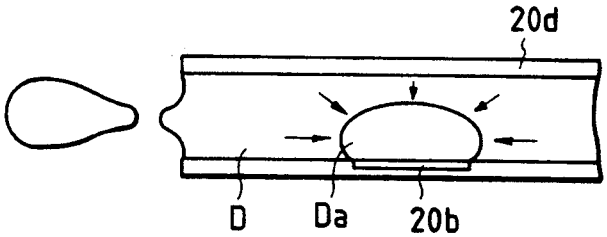
Figure 4F:
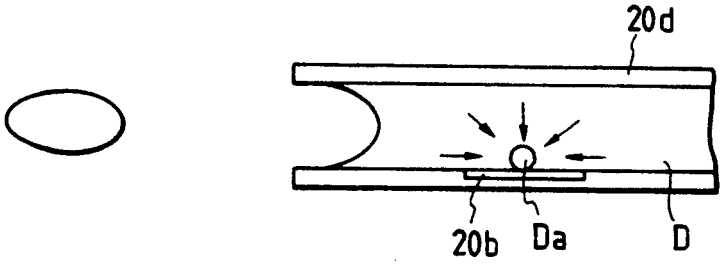
Figure 4G:
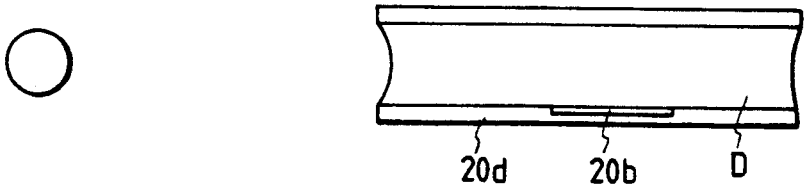

When the bubble Da is grown to the maximum extent as shown in FIG. 4D, the ink droplet is pushed out of the discharge opening of the nozzle 20*d*. When the electrical/thermal converter 20*b* is disenergized, as shown in FIG. 4E, the grown bubble Da is cooled by the ink in the nozzle 20*d* to contract. Thus, with the growth and contraction of the bubble, the ink droplet is discharged from the discharge opening. Further, as shown in FIG. 4F, the ink contacting the surface of the electrical/thermal converter 20*b* is quickly cooled, thus diminishing the bubble or reducing the volume of a bubble to the negligible extent. When the bubble is diminished, as shown in FIG. 4G, the ink is replenished in the nozzle 20*d* from the common liquid chamber 20*g* by a capillary phenomenon, thus preparing the next formation of the ink droplet.

Accordingly, by selectively energizing the electrical/thermal converters 20*b* in response to the image signal, the ink image can be recorded on the sheet.

Belt Conveying Portion

As shown in FIGS. 1A to 1C, the belt conveying portion 4 is constituted by an endless belt 4*e* entrained around a driving roller 4*a* and guide rollers 4*b*, 4*c*, 4*d* which are rotatably supported on a frame (not shown). A platen 4*f* acting as a planar member for supporting the endless belt 4*e* in parallel with the image recording means 2 is disposed in contact with the belt portion which is disposed between the driving roller 4*a* and the guide roller 4*b* in confronting relation to the image recording means 2.

Upon the recording operation, by rotatingly driving the driving roller 4*a*, the endless belt 4*e* is rotated in a direction shown by the arrow a in FIG. 1C to convey the cut sheet 3 in the same direction in synchronism with the recording operation of the image recording means 2. After the recording, the cut sheet 3 is sent to the fixing and ejecting portion 9. The endless belt 4*e* is charged by a charger 4*g* (FIG. 2) so that the cut sheet is electrostatically absorbed by the charged endless belt 4*e*. The absorbing roller 5 presses the cut sheet against the endless belt 4*e* so that the whole surface of the cut sheet is absorbed by the endless belt 4*e*.

Support Releasing Mechanism

As shown in FIGS. 1A to 1C, the support releasing mechanism 6 serves to shift the belt conveying portion 4 between a lifted image recording position where the belt conveying portion is spaced apart from the image recording means 2 by a distance of about 1 mm or less, and a lowered releasing position where the belt conveying portion is spaced far away from the recording means. In these positions, the belt conveying portion 4 is maintained substantially in parallel with the image recording means 2. When the belt conveying portion 4 is shifted between the image recording position and the releasing position, the belt conveying portion is inclined. To this end, the support releasing mechanism comprises a support arm 6a for connecting the belt conveying portion 4 to the frame (not shown) of the recording apparatus A, and a lifter mechanism 6b for lifting the support arm 6a and the belt conveying portion 4.

The support arm 6a has one end pivotally connected to the frame (not shown) of the recording apparatus A via a pivot pin $6a_1$ and the other end pivotally connected to a shaft 6a of the driving roller 4a of the belt conveying portion 4.

The lifter mechanism 6 comprises a pair of left and right link members $6b_3$, $6b_4$ having lower ends pivotally connected to the frame (not shown) of the recording apparatus A via pivot pins $6b_1$, $6b_2$, respectively, and a connecting link $6b_5$ connecting the left and right link members $6b_3$, $6b_4$ to each other at their intermediate portions. A guide roller 6c rotatingly contacting with a curved surface $6a_3$formed on a bottom surface of the support arm 6a is rotatably mounted on an upper end of the left link member $6b_3$ and a guide roller 6d rotatingly contacting with a lower surface of the platen 4f is rotatably mounted on an upper end of the right link member $6b_4$.

When the support releasing mechanism 6 shifts the belt conveying portion 4 from the releasing position (FIG. 1A) to the image recording position (FIG. 1C) by means of its support arm 6a and lift mechanism 6b, a downstream portion (left portion in FIGS. 1A to 1C) of the belt conveying portion 4 is first lifted and then an upstream portion (right portion in FIGS. 1A to 1C) of the belt conveying portion is lifted. When the belt conveying portion is shifted from the image recording position to the releasing position, the upstream portion of the belt conveying portion is lowered first and then the downstream portion is lowered.

Incidentally, a lever (not shown) for swinging the right link member $6b_4$ is fixedly mounted on the pin $6b_2$ formed on the lower end of the right link member $6b_4$ so that this right link member $6b_4$ can be rocked around the pin $6b_2$ through the lever. Further, the guide rollers 6c and 6d are biased to be always urged against the lower surfaces of the support arm 6a and of the platen 4f, respectively, by means of springs (not shown).

The left and right link members $6b_3$, $6b_4$ are constituted by two members $6b_6$, $6b_7$ and two members $6b_8$, $6b_9$, respectively, which members are connected to each other by pins $6b_{10}$, $6b_{11}$, respectively. The members $6b_6$, $6b_7$ and $6b_8$, $6b_9$ are expandably and foldably interconnected to each other and are normally held in the expanded condition by the springs (not shown), respectively, so that the guide rollers 6c and 6d are urged against the lower surfaces of the support arm 6a and of the platen 4f, respectively.

Next, the operation of the support releasing mechanism according to the first embodiment will be explained with reference to FIGS. 1A to 1C.

As shown in FIG. 1A, in the releasing position where the belt conveying portion 4 is lowered to be spaced apart from the image recording means 2, when the the right link member $6b_4$ is rotated around the pin $6b_2$ in a direction shown by the arrow a by manipulating a lever (not shown), the left link member $6b_3$ is also rotated around the pin $6b_1$ in the same direction through the connecting link $6b_5$. Further, the support arm 6a is rotated around the pin $6b_1$ in a direction shown by the arrow c through the left link member $6b_3$, thus lifting the belt conveying portion 4.

FIG. 1B shows a condition that the belt conveying portion 4 is being lifted. As shown in FIG. 1B, first of all, the downstream portion (left portion) of the belt conveying portion 4 is lifted by the left link member $6b_3$ and the support arm 6a, and then the upstream portion (right portion) of the belt conveying portion 4 is lifted by the right link member $6b_4$, until the support arm 6a is abutted against a stopper (not shown) formed on the recording apparatus A.

In this case, a maximum inclined angle 0 between the flat portion of the belt conveying portion 4 and the flat portion of the image recording portion 2 is selected to have a value of 2°~60°, preferably 2°~30°. Now, if this angle is smaller than 2°, the air will be pushed up toward the image recording means 2 by the belt conveying portion 4, thus clogging the ink discharge openings $20d_l$ with dirt, dust and the like; whereas, if the angle is larger than 60°, the lifting operation will be difficult.

When the right link member $6b_4$ is rotated around the pin $6b_2$ in a direction shown by the arrow a from the condition shown in FIG. 1B by further manipulating the lever (not shown), the right link member $6b_4$ is cocked uprightly. On the other hand, the support arm 6a is abutted against the stopper (not shown) of the apparatus, thus preventing further rotation of the support arm. As a result, the guide roller 6c rolls on and shifts along the curved surface $6a_3$ of the support arm 6a, thus rotating the left link member $6b_3$ in the direction a to cock the latter.

Thereby, the belt conveying portion 4 is rotated around the driving roller 4a in a direction shown by the arrow d in FIG. 1B to approach the image recording means 2, with the result that the belt conveying portion 4 is brought into the recording position where it is held parallel with and in the vicinity of the image recording means 2, as shown in FIG. 1C.

On the other hand, when the belt conveying portion is shifted from the recording position shown in FIG. 1C to the releasing position, the reverse operation may be effected. In this case, the upstream portion of the belt conveying portion 4 is first lowered, and, when the condition as shown in FIG. 1B is reached, the downstream portion is also lowered until the belt conveying portion is spaced apart far from the image recording means 2 in parallel therewith as shown in FIG. 1A.

According to the first embodiment of the present invention, in the releasing position, since the belt conveying portion 4 is spaced apart from the image recording means 2 in parallel therewith as shown in FIG. 1A, it is possible to provide a uniform space between these elements.

Further, when the belt conveying portion is shifted from the releasing position to the image recording position, since the belt conveying portion 4 is approaching the image recording means 2 in the inclined fashion as shown in FIG. 1B, the air between them flows to the right as shown by the arrows in FIG. 1B, thus avoiding the danger that the ink discharge openings $20d_l$ are clogged with dirt, dust, paper powder and the like during the lifting of the belt conveying portion 4. Further, since the percentage of the weight of the belt conveying portion 4 acting on the support releasing mechanism 6 is smaller than that in the case where the belt conveying portion 4 is lifted while keeping the parallelism between the belt conveying portion and the image recording means, there is no need to provide a driving source, a bumper mechanism and the like, thus simplifying the construction of the apparatus.

Furthermore, when the belt conveying portion 4 is shifted from the image recording position to the releasing position, since the upstream portion of the belt conveying portion 4 is first released, it is not necessary to release all of the belt conveying portion 4 when such a relatively slight jam condition occurs such as when a curled leading end of the cut sheet 3 is abutted against the head portion of the image recording means 2 to deviate from the belt conveying portion 4, thus performing the jam treatment effectively.

Next, a second embodiment of the present invention will be explained.

Figure 5B:
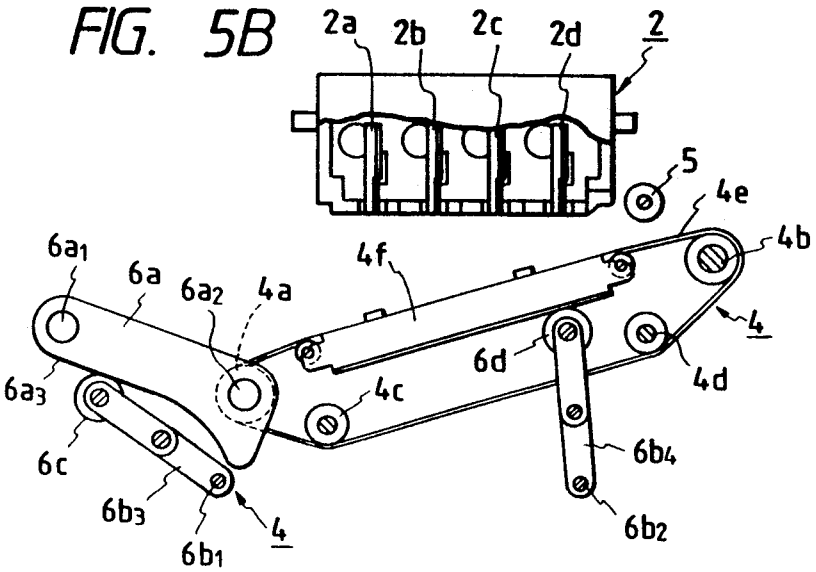
FIGS. 5A to 5C are explanatory views for explaining an operation of a support releasing mechanism according to a second embodiment of the present invention.
Figure 5A:
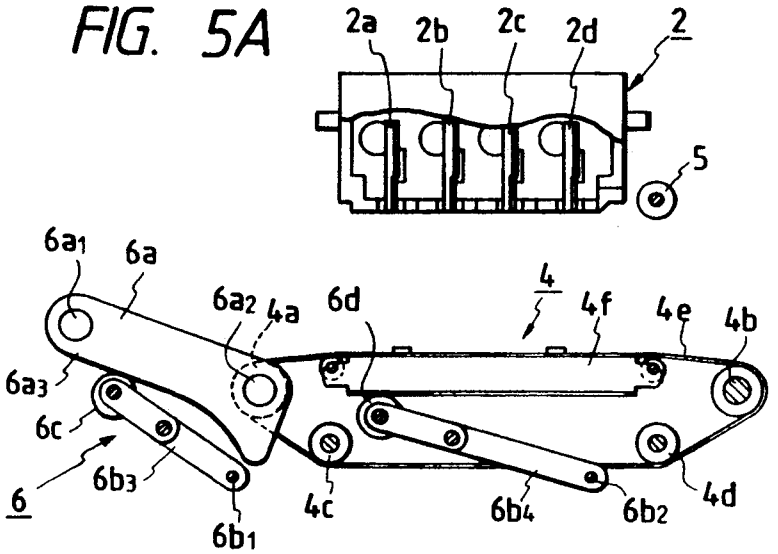
Figure 5C:
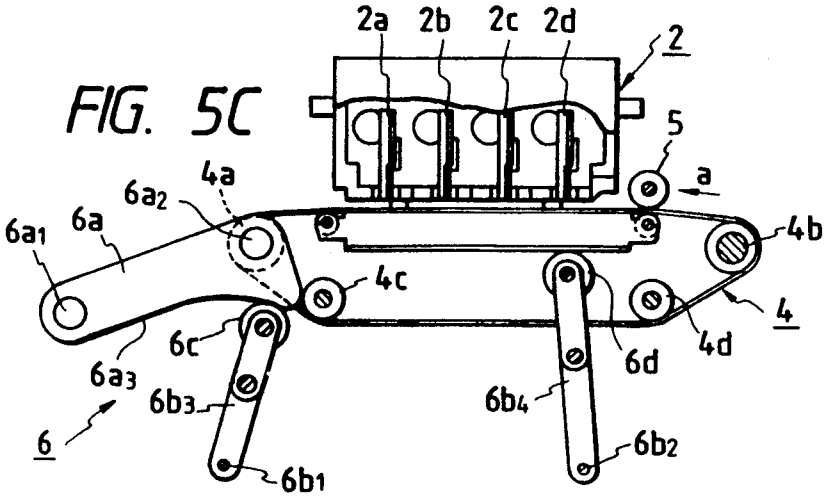

FIGS. 5A to 5C show a support releasing mechanism 6 according to another embodiment. Incidentally, the elements in FIGS. 5A to 5C the same as those shown in FIGS. 1A to 1C are designated by the same reference numerals and a detailed explanation of those elements will be omitted.

The second embodiment differs from the aforementioned first embodiment in the points that the connecting link $6b_5$ interconnecting the left link member $6b_3$ and the right link member $6b_4$ is omitted and that a lever (not shown) is also provided on the left link member $6b_3$ so that the left link member $6b_3$ and the right link member $6b_4$ can be rotated independently.

With this arrangement, either the left or right link member $6b_3$ or $6b_4$ can be firstly rotated in the upright condition prior to the rotation of the other link member; accordingly, for example, as shown in FIG. 5B, the upstream portion of the belt conveying portion 4 can be first cocked first and then the downstream portion can be cocked. Further, similar to the aforementioned first embodiment, the downstream portion of the belt conveying portion 4 may be cocked firstly.

In addition, when the sheet is jammed in the upstream portion or the downstream portion of the belt conveying portion 4, only by lowering the upstream portion or the downstream portion of the belt conveying portion 4, the jammed sheet can be removed, thus facilitating the jam treatment.

Further, even if the belt conveying portion 4 is heavy, since the left and right link members $6b_3$, $6b_4$ can be rotated independently through the respective levers (not shown), it is possible to alleviate the load acting on each lever.

Next, a third embodiment of the present invention will be explained.

FIGS. 6A to 6E show a support releasing mechanism 6 according to a further embodiment. Incidentally, the elements in FIGS. 6A to 6C the same as those shown in FIGS. 1A to 1C are designated by the same reference numerals and detailed explanation thereof will be omitted.

Figure 6A:
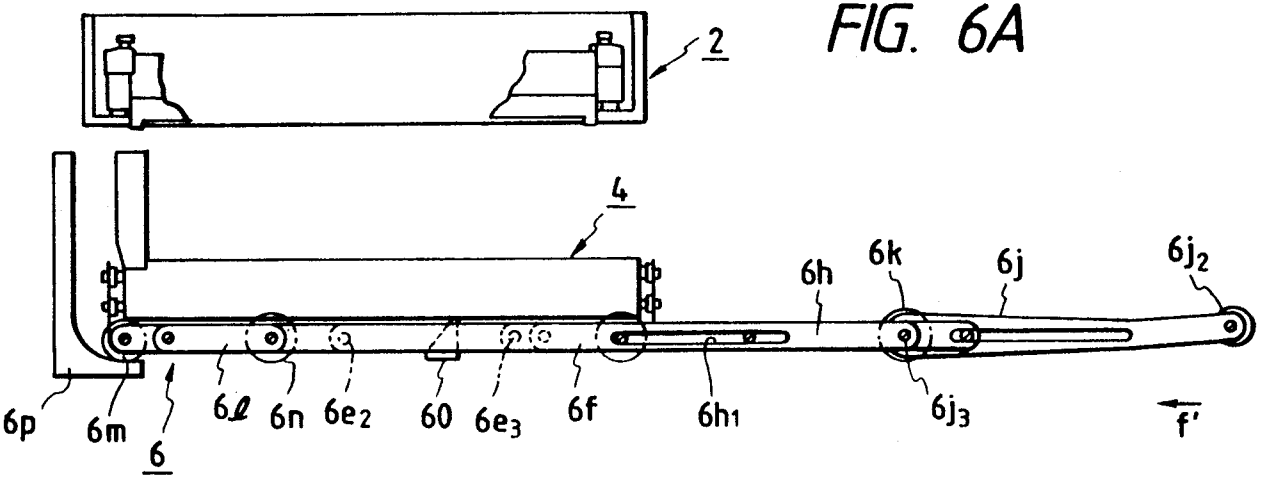
FIGS. 6A to 6E are explanatory views for explaining an operation of a support releasing mechanism according to a third embodiment of the present invention.
Figure 6B:
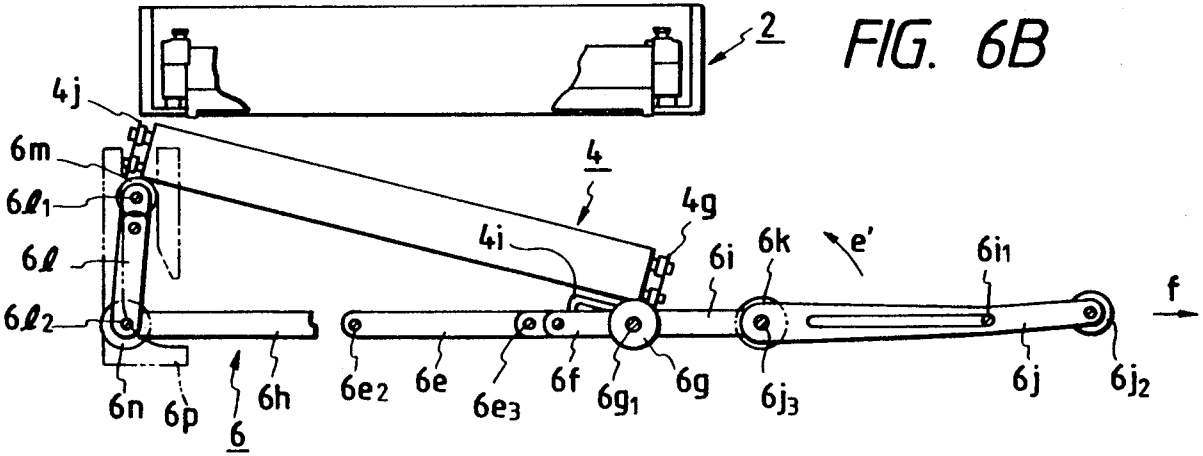
Figure 6D:
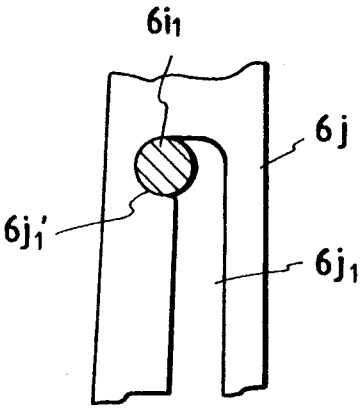
Figure 6E:
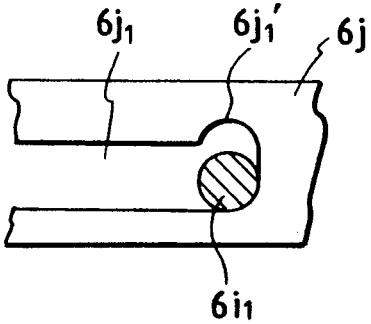
Figure 6C:
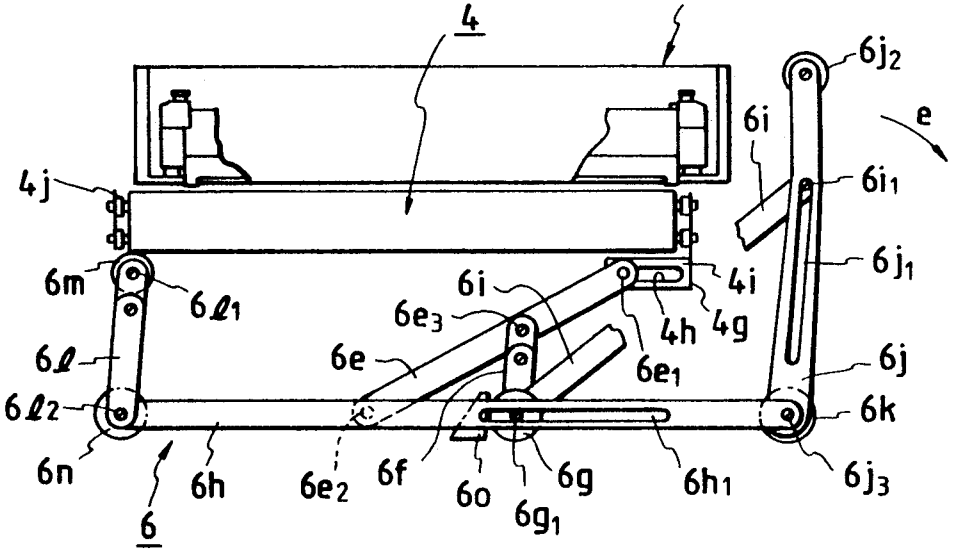

In this third embodiment, instead of the upstream and downstream portions of the belt conveying portion 4 being lifted and lowered as in the aforementioned first and second embodiments, a front portion (right portion in FIGS. 6A to 6C) and a rear portion (left portion in FIGS. 6A to 6C) of the belt conveying portion 4 are lifted and lowered, and the support releasing mechanism is constituted as shown in FIG. 6C.

More particularly, a front plate 4g forming a part of the belt conveying portion 4 is provided on the front portion of the belt conveying portion 4, and a connecting plate 4i having a horizontal slot 4h is attached to a lower surface of the front plate 4g. Further, a pin $6e_1$ formed on an upper end of a front support arm 6e is slidably received in the horizontal slot 4h.

The front support arm 6e is pivotally connected at its lower end to a frame (not shown) of the recording apparatus A via a pivot pin $6e_2$ Further, the front support arm 6e is pivotally connected at its intermediate portion to one end of an intermediate support arm 6f having a toggle mechanism, via a pivot pin $6e_3$.

On the other end of the intermediate support arm 6f, there is rotatably mounted a guide roller 6g via a pin $6g_1$, which guide roller can roll, for example, on a stay (not shown) of the recording apparatus A. The pin $6g_1$ is slidably received in a longitudinal slit $6h_1$ formed in a main link plate 6h disposed below and substantially in parallel with the belt conveying portion 4. Further, a front link plate 6i is pivotally connected at its lower end to the pin $6g_1$.

The front link plate 6i is slidably and pivotally received at its upper end in a slit $6j_1$ formed in a handle plate 6j disposed in front of the belt conveying portion 4, via a pin $6i_1$. The handle plate 6j serves to operate the support releasing mechanism 6 and is provided at its upper end with a roller-shaped handle $6j_2$ and is pivotally connected at its lower end to one end (right end in FIG. 6C) of the main link plate 6h, via a pivot pin $6j_3$. A guide roller 6k rolling on the stay (not shown) of the recording apparatus A is rotatably mounted on the pivot pin $6j_3$.

On the other hand, a rear side plate 4j is mounted at the rear side of the belt conveying portion 4, and a rear support arm 6l having a toggle mechanism is pivotally connected at its upper end to the rear side plate 4j via a pivot pin $6l_1$. Further, a guide roller 6m is rotatably mounted on the pin $6l_1$.

The rear support arm 6l is pivotally connected at its lower end to the other end (left end in FIG. 6C) of the main link plate 6h via a pivot pin $6l_2$. On the pivot pin $6l_2$, there is rotatably mounted a guide roller 6n rolling on the stay (not shown) of the recording apparatus A.

Incidentally, in FIGS. 6A and 6C, the reference numeral 6o denotes a stopper for the guide roller 6g. Further, in FIGS. 6A and 6B, the reference numeral 6p denotes a guide portion for guiding the guide roller 6m.

According to this third embodiment, in order to change from the image recording position shown in FIG. 6C to the releasing position shown in FIG. 6A, first of all, by manipulating the handle $6j_2$, the handle plate 6j is rotated in a direction shown by the arrow e in FIG. 6C to bring it in a horizontal position. In this case, as shown in FIG. 6D, since the pin $6i_1$ is engaged by a recess $6i_1'$ disposed at one end of the slit $6j_1$, when the handle plate 6j is rotated in the direction e, the front link plate 6i is pulled in the same direction, with the result that the guide roller 6g is rolling while sliding the pin $6g_1$ to the left in FIG. 6C along the slit $6h_1$. Consequently, the lower end of the intermediate support arm 6f is pulled, thus bringing down the front support arm 6e.

As a result, the front portion of the belt conveying portion 4 is rotated downwardly around the pin $6l_1$, thus reaching a condition as shown in FIG. 6B. In the condition shown in FIG. 6B, since the main link plate 6h is not shifted to the right in FIG. 6B, the rear support arm $6l$ is not brought down, and, accordingly, the rear portion of the belt conveying portion 4 is not lowered.

Then, when the handle $6j_2$ is pulled in a direction shown by the arrow f in FIG. 6B from the condition shown in FIG. 6B, the handle plate $6j$, pin $6j_3$ and main link plate $6h$ are shifted in order in the same direction. Consequently, the guide roller $6m$ on the pin $6l_1$ is lowered substantially vertically along the guide portion $6p$, with the result that the rear portion of the belt conveying portion 4 is lowered substantially vertically, thus releasing the support releasing mechanism in a condition that the flat portion of the belt conveying portion 4 is maintained substantially in parallel with the flat portion of the image recording means 2 as shown in FIG. 6A.

When the guide roller $6m$ is lowered, as shown in FIG. 6E, since the pin $6j_1$ of the front link plate $6j$ is escaped from the recess $6j_1'$ due to the gravitational force, the members from the front link plate $6j$ to the front support arm $6e$ are not pulled.

In order to return from the releasing position shown in FIG. 6A to the image recording position, the reverse operation may be effected. That is to say, the handle $6j_2$ is first pushed in a direction f' opposite to the direction f, and then, when the rear portion of the belt conveying portion 4 is lifted up to the condition shown in FIG. 6B, the handle $6j_2$ is rotated in a direction shown by the arrow e', thus cocking the handle plate $6j$. Consequently, as shown in FIG. 6C, the belt conveying portion 4 is lifted to approach the image recording means 2, thus causing the belt conveying portion 4 be situated substantially in parallel with the image recording means 2.

Also, in this third embodiment, since the flat portion of the belt conveying portion 4 is spaced from the image recording means 2 in parallel thereto as shown in FIG. 6A, the space between the belt conveying portion and the image recording means can be made large and uniform, whereby the jam treatment can be easily effected, and the recording apparatus can be made small-sized because a large space is not required below the belt conveying portion 4.

Further, when the releasing position is changed to the image recording position, since the front portion of the belt conveying portion 4 is rotated upwardly around the pin $6l_1$ at the rear side of the belt conveying portion 4 as shown in FIG. 6B (that is, the belt conveying portion approaches the image recording means 2 in the inclined fashion), the air between the belt conveying portion and the image recording means flows toward the front side of the belt conveying portion 4. Thus, similar to the first and second embodiments, when the belt conveying portion 4 is lifted, it is not, feared that dirt, dust, paper powder and the like will adhere to the ink discharge openings $20d_1$ of the image recording means to clog the same. Further, since the percentage of the weight of the belt conveying portion 4 acting on the support releasing mechanism 6 is smaller, the construction of the apparatus can be simplified.

Lastly, other embodiments or alterations will be explained.

Image Recording Means

As the image recording means 2, other than the above-mentioned combination of the discharge openings, liquid passages and electrical/thermal converters, an image recording means wherein heat acting portions are disposed at curved areas as disclosed in U.S. Pat. No. 4,558,333 and the Japanese Patent Laid-Open No. 59-123670 can be adopted.

Further, while an example that the ink is supplied to the recording heads from the ink cartridges removably mounted on the recording apparatus in the image recording means was explained, a disposable recording head wherein an ink containing chamber is formed in the head and the head itself can be replaced when the ink is used up may be utilized.

Furthermore, instead of the ink jet recording means, an image recording means by which a toner image is formed on an image bearing member such as a photosensitive drum and the toner image is transferred onto a sheet can be applied to the recording apparatus according to the present invention. In this case, it is prevented that the surface of the drum is damaged by and/or the transferred image is badly influenced by dirt, dust, paper powder and the like entrained in the air flow generated by lifting the belt conveying portion 4.

Support Releasing Mechanism

While an example that the support releasing mechanism 6 supports the belt conveying portion 4 in such a manner that the latter can be shifted toward and away from the image recording means was explained, the support releasing mechanism is not limited to this example, but may support the image recording means 2 in such a manner that the latter can be shifted toward and away from the belt conveying portion 4. Further, the support releasing mechanism may be so constructed that it supports both the belt conveying portion 4 and the image recording means 2 to shift them toward and away relative to each other.

Incidentally, the recording apparatus according to the present invention can be applied to image outputting thermal equipment of an information processing system such as a computer, a facsimile system having a communication function, or the like, as well as a copying machine incorporating the scanner portion 1.

Incidentally, when the ink image jet recording means is used, the belt conveying portion is spaced apart from the ink jet recording heads by a predetermined distance in the image recording position; whereas, when the image bearing member is used, in the image recording position, the belt conveying portion may be contacted with the ink jet recording heads or may be spaced apart from the ink jet recording heads by a predetermined distance.

What is claimed is:

1. A recording apparatus comprising:

conveying means for holding a recording sheet and for conveying the sheet in a conveying direction;

recording means disposed in confronting relation to said conveying means for recording an image on the sheet being conveyed by said conveying means; and supporting means for shiftably supporting said conveying means for movement between a recording position, where said conveying means and said recording means are in contact or in close proximity for recording by said recording means, and a non-recording position where said conveying means and said recording means are separated in parallel;

wherein said supporting means causes said conveying means to be inclined toward the sheet conveying direction during movement from the non-recording position to the recording position by firstly bringing a part of said conveying means near to said recording means.

2. A recording apparatus according to claim 1, wherein said conveying means comprises a belt capable of shifting to contact the sheet being conveyed.

3. A recording apparatus according to claim 2, further comprising absorbing means for adhering the recording sheet to said belt.

4. A recording apparatus according to claim 3, wherein said absorbing means comprises charging means for charging said belt.

5. A recording apparatus according to claim 1, wherein said recording means comprises an ink jet head for discharging ink to record an image on the recording sheet.

6. A recording apparatus according to claim 5, wherein said ink jet head comprises thermal energy generating elements for generating ink droplets to form the image.

7. A recording apparatus according to claim 1, wherein said supporting means causes said conveying means to be inclined toward a direction substantially perpendicular to the sheet conveying direction during movement between the non-recording position to the recording position.

8. A recording apparatus according to claim 1, wherein said supporting means comprises a link mechanism for connecting said conveying means to a body of the recording apparatus.

9. A recording apparatus according to claim 1, wherein said support means comprises a link mechanism.

10. A recording apparatus comprising:

conveying means for conveying a recording sheet contacting said conveying means;

recording means disposed in confronting relation to said conveying means for recording an image on the sheet being conveyed by said conveying means; and supporting means for slidingly supporting said conveying means for movement between a recording position where said conveying means and said recording means are in contact or close proximity for recording by said recording means and a non-recording position where said conveying means and said recording means are separated in parallel;

wherein, said support means is constructed so that during movement of said conveying means from the non-recording position to the recording position, and after said conveying means assumes an inclined position relative to said conveying means by brining one end of said conveying means near to said recording means, another end of said conveying means approaches said recording means.

11. A recording apparatus according to claim 10, wherein said recording means comprises thermal energy generating elements for generating ink droplets to form the image.

12. A recording apparatus according to claim 10, wherein said conveying means is located near said recording means in the recording position.

13. A recording apparatus according to claim 10, wherein said support means comprises a link mechanism.

14. A recording apparatus comprising:

conveying means for conveying a recording sheet and for conveying the sheet in a conveying direction;

recording means disposed in confronting relation to said conveying means for recording an image on the sheet being conveyed by said conveying means, said recording means comprising ink jet nozzles for discharging ink to record an image on the recording sheet; and supporting means for slidingly supporting said conveying means for movement between a recording position where said conveying means and said recording means are in contact or close proximity for recording by said recording means, and a non-recording position where said conveying means and said recording means are separated in parallel;

wherein, said support means causes said conveying means to be inclined toward the sheet conveying direction during movement from the non-recording position to the recording position.

15. A recording apparatus according to claim 14, wherein said conveying means comprises a belt capable of shifting to contact the sheet being conveyed.

16. A recording apparatus according to claim 15, further comprising absorbing means for adhering the recording sheet to said belt.

17. A recording apparatus according to claim 16, wherein said absorbing means comprising charging means for charging said belt.

18. A recording apparatus according to claim 14, wherein said recording means comprises thermal energy generating elements for generating ink droplets to form the image.

19. A recording apparatus according to claim 14, wherein said supporting means causes aid conveying means to be inclined toward a direction substantially perpendicular to the sheet conveying direction during movement between the non-recording position to the recording position.

20. A recording apparatus according to claim 14, wherein said supporting means comprises a link mechanism for connecting said conveying means to a body of the recording apparatus.

* * * * *

UNITED STATES PATENT AND TRADEMARK OFFICE

CERTIFICATE OF CORRECTION

PATENT NO. : 5,274,399

DATED : December 28, 1993

INVENTOR(S) : TAKASHI UCHIDA, ET AL.

It is certified that error appears in the above-indentified patent and that said Letters Patent is hereby corrected as shown below:

Column 1,

Line 21, "discloses" should read --discloses a--;
Line 29, "as" should be deleted;
Line 32, "as" should be deleted; and
Line 42, "transfer," should read --transfer--.

Column 5,

Line 17, "shaft 6a" should read --shaft $6a_2$--.

Column 6,

Line 17, "angle 0" should read --angle θ--.

Column 7,

Line 12, "such" should be deleted; and
Line 38, "first" (first occurrence) should be deleted.

Column 8,

Line 10, "pin $6e_2$" should read --pin $6e_2$--.

UNITED STATES PATENT AND TRADEMARK OFFICE

CERTIFICATE OF CORRECTION

PATENT NO. : 5,274,399

DATED : December 28, 1993

INVENTOR(S) : TAKASHI UCHIDA, ET AL.

It is certified that error appears in the above-indentified patent and that said Letters Patent is hereby corrected as shown below:

Column 9,
Line 53, "not," should read --not--.

Column 11,
Line 53, "brining" should read --bringing--.

Column 12,
Line 12, "conveying" (second occurrence) should read --holding--;
Line 21, "slidingly" should read --shiftably--;
Line 28, "wherein," should read --wherein--, and "support" should read --supporting--; and
Line 46, "aid" should read --said--.

Signed and Sealed this

Sixteenth Day of August, 1994

Bruce Lehman

*Attest:*

BRUCE LEHMAN

*Attesting Officer*

*Commissioner of Patents and Trademarks*